United States Patent [19]
Hermann
[11] 4,428,211
[45] Jan. 31, 1984

[54] LOCKING DEVICE

[76] Inventor: Robert Hermann, Box 218, Stronghurst, Ill. 61480

[21] Appl. No.: 262,815

[22] Filed: May 12, 1981

[51] Int. Cl.³ ..... E05B 67/36
[52] U.S. Cl. ..... 70/34; 70/455
[58] Field of Search ..... 70/32, 33, 34, 18, 23, 70/229, 231, 232, 455

[56] References Cited

U.S. PATENT DOCUMENTS

| | | | |
|---|---|---|---|
| 1,366,804 | 1/1921 | Jackson | 70/455 |
| 1,436,488 | 11/1922 | Facciano | 70/455 |
| 1,971,797 | 8/1934 | Shinm | 70/32 |
| 2,656,706 | 10/1953 | Lucas | 70/232 |
| 2,999,377 | 9/1961 | Raye | 70/32 |
| 3,785,670 | 1/1974 | Smith | 70/34 |
| 3,797,286 | 3/1974 | Saparito | 70/455 |
| 4,037,438 | 7/1977 | Miller | 70/18 |

*Primary Examiner*—Robert L. Wolfe
*Attorney, Agent, or Firm*—Antonelli, Terry & Wands

[57] ABSTRACT

A locking device of the type having a lock cylinder containing a lock plug with a threaded rod connected thereto in a manner causing rotation of the rod with rotation of the lock plug by a key operating the tumbler includes a relatively massive cylindrical lock housing having a bore extending axially therethrough, the lock cylinder being fastened against rotational and axial movements relative to the lock housing, and a relatively massive cylindrical sleeve member with a blind bore therein and a screw threaded surface arrangement in a portion of the blind bore for threadingly engaging the threaded rod. In accordance with a first embodiment, relative rotation between the lock housing and the sleeve member is prevented by a counterbore in an open end of the blind bore of the sleeve member of non-circular transverse cross section and a portion of the exterior of the lock housing of reduced circumference, non-circular transverse cross section that is at least partially receivable in the counterbore. In accordance with a second embodiment, such relative rotation between the lock housing and the sleeve member is effectuated by a pair of pivotally connected semi-annular shackle members, the sleeve and lock housing being tangentially secured to a free end of a respective one of each of the semi-annular members. A cover cap assembly is provided which weatherproofs the lock cylinder and may serve to protect and camouflage a fastening screw for the lock cylinder.

10 Claims, 5 Drawing Figures

FIG. 4.
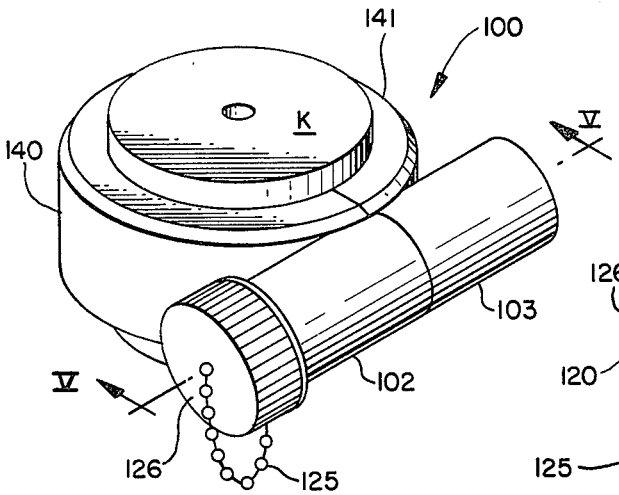
FIG. 5.
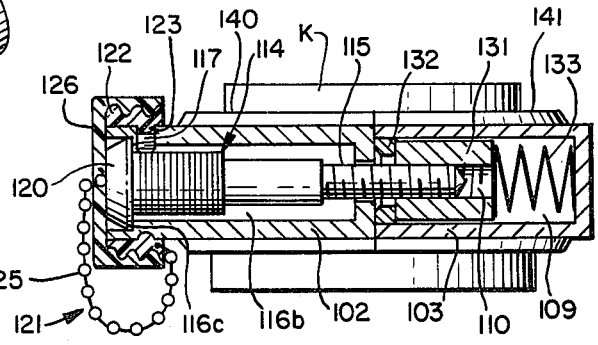
FIG. 1.
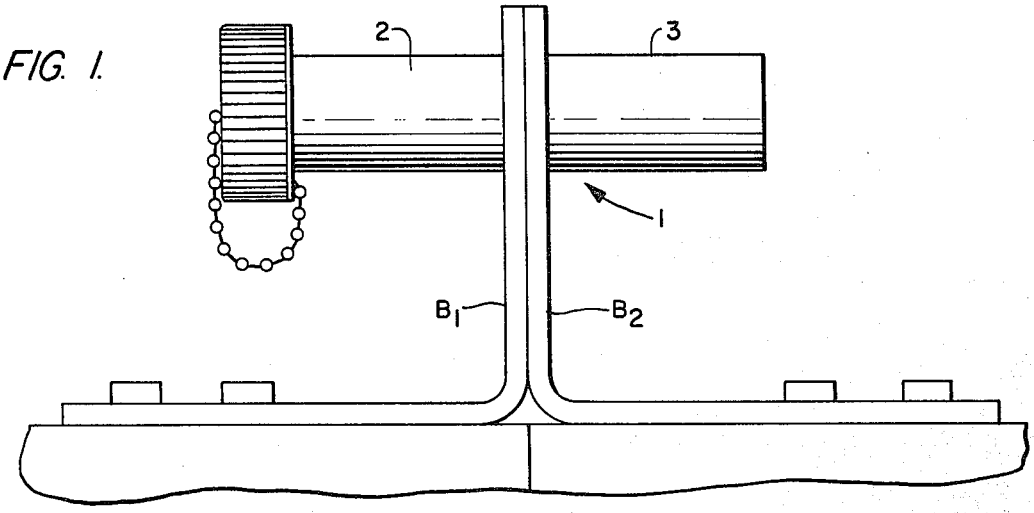
FIG. 3.
FIG. 2.
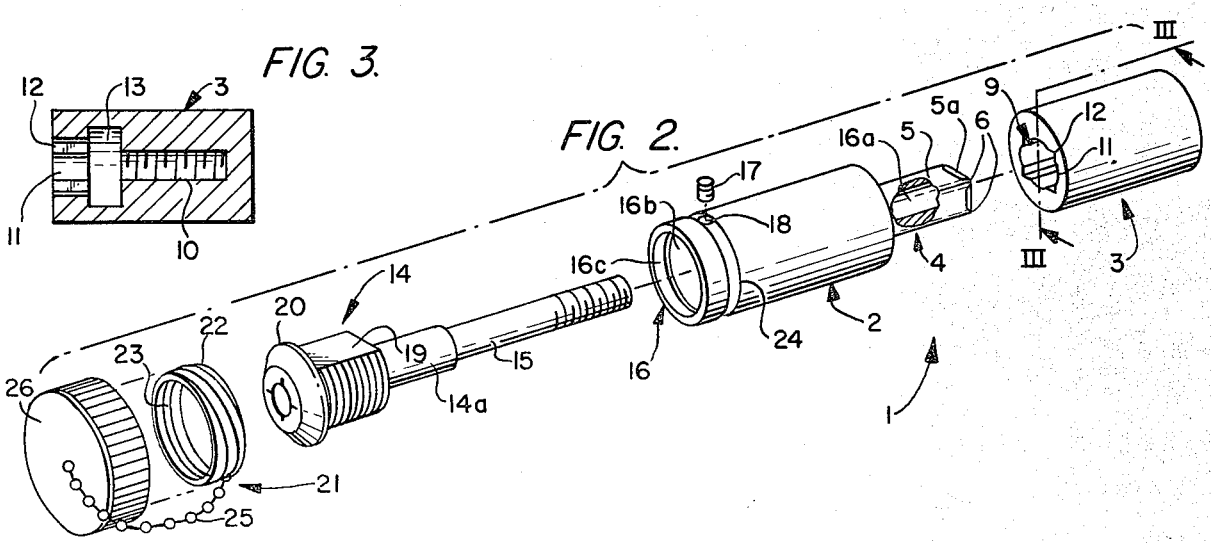

LOCKING DEVICE

BACKGROUND AND SUMMARY OF THE INVENTION

The present invention relates to locking devices of the type which utilize a lock cylinder containing a lock plug that is rotatable by rotation of a key inserted in the lock cylinder, a threaded rod being connected to the lock plug in a manner such that the threaded rod rotates with rotation of the lock plug. More particularly, the present invention is directed to locking device constructions which increase the applications to which such lock plugs can be utilized as well as improvements in particular locking device arrangements.

Locking devices of the above mentioned type are known. For example, the Chicago Lock Company "Chicago Ace Stud Lock" series CH-4107 is a housingless stud lock which is retained on a wall by a nut threaded thereon. Such locks are conventionally utilized for drawing doors and covers down tight on coin meters, vending machines and the like. However, such have not been utilized in a padlock-type environment.

U.S. Pat. No. 3,600,912 shows a screw-type lock assembly for locking sliding members. In the arrangement according to this patent, a removable lock plug is received within a cylindrical lock housing, which lock housing is passed through the sliding member and a wall frame member so as to prevent shifting of the sliding member. In the assembled position, the housing engages a threaded plate permanently attached to an internal wall frame portion and is held against relative rotation with respect thereto. A threaded rod associated with the lock tumblers can then be threaded into engagement with the threads of the plate by rotation of the key so as to secure the assembly in place. Such an arrangement is not utilizable as a padlock in conjunction with hasps, and since it has multiple parts which are not fastened together in an unlocked position of the assembly, the lock can be rendered useless by a loss of one of the parts. Furthermore, no arrangement for weather proofing the locking assembly is provided. In another known application of screw-type locks according to U.S. Pat. No. 2,565,659, a speedometer cable fitting lock utilizes a key operated, tumbler equipped screw plug for securing a pair of semi-annular shackle members together. However, since the shackle halves must be pivotally brought into engagement with each other, and since threaded engagement of the locking plug threads with threads in one of the shackle members can only occur when the two are in axial alignment with each other, the locking plug is a removable member that is not connected to a lock housing of the shackle in an unlocked condition so that the semi-annular members can be closed about a cable, the plug inserted through one of the shackle members and progressively threaded down into the other of the shackle members. Such an arrangement is both cumbersome to use and subject to being rendered useless due to a misplacing of the locking plug. Furthermore, no provisions are made for weatherproofing the locking plug.

Accordingly, it is an object of the present invention to provide improved padlock and shackle-type locking arrangements utilizing locking devices of the initially mentioned type.

It is a further object to achieve such improved screw-type locks wherein the lock cylinder can be securely retained within a protective housing in a manner that eliminates any requirement for the lock cylinder to be detatchable therefrom in use.

It is yet another object in accordance with the present invention to provide locks of the previously described type which are weatherproof for outdoor uses.

Still a further object of the present invention is to achieve locks of the screw-type that are constructed in a manner that avoids part of the lock assembly from becoming lost due to inadvertent detatchment.

The above noted objects are achieved in accordance with a first embodiment of the invention designed for padlock-type applications by the provision of a relatively massive cylindrical lock housing within which a lock cylinder is fastened against rotational and axial movements relative to the lock housing, and from which a screw threaded rod (that is connected with the tumbler equipped, lock plug so as to rotate with rotation of the lock plug by a key) extends, and a relatively massive cylindrical sleeve member having a blind bore therein, a portion of which is threaded for engagingly receiving the threaded rod. Relative rotation between the lock housing and the sleeve member is achieved, in one embodiment, by a counter bore construction on the sleeve member of non-circular cross section being engageable with a male portion of the lock housing that is also of a non-circular transverse cross section. This male portion of the lock housing is greater in length than the depth of the counter bore so as to enable a hasp to be secured thereon between the lock housing and sleeve member.

In accordance with a second embodiment, particularly suited for trailer theft prevention applications, relative rotation between the lock housing and sleeve member is achieved by a shackle that is formed of a pair of semi-annular members to which the lock housing and sleeve member are tangentially permanently fastened at a respective end of each. Fastening of the screw thread rod into the sleeve member (without the lock cylinder being removable and despite the fact closing of the shackle members requires a pivotal swinging movement) is facilitated by constructing the threaded portion of the blind bore as a threaded sleeve member that is displaceably received and retained within the blind bore.

In both embodiments, the lock cylinder is rendered weather proof by a cover cap assembly that is provided with a resilient, externally threaded sleeve mounted upon the exterior of the lock housing and a cover cap retainable upon the threaded sleeve. The cap and threaded sleeve are interconnected by a flexible coupling such as a chain. Still further, the sleeve can be utilized to hide the fastening means securing the lock plug within the lock housing.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a side elevational view of a padlock embodiment in accordance with the present invention.

FIG. 2 is an exploded view of the lock of FIG. 2.

FIG. 3 is a cross sectional view of the sleeve member of FIGS. 1 and 2, taken along line III—III of FIG. 2.

FIG. 4 is a perspective view of a kingpin lock embodiment in accordance with the present invention.

FIG. 5 is a cross sectional view taken along line V—V of FIG. 4.

DETAILED DESCRIPTION OF THE PREFERRED EMBODIMENTS

A first, padlock, embodiment in accordance with the present invention can be seen with reference to FIGS. 1–3. The lock in accordance with this embodiment is designed for use with numerous different types of hasps. For the purpose of illustration and simplicity, FIG. 1 shows the lock 1 securing a hasp formed by a pair of brackets $B_1$, $B_2$, by passing through an aperture formed therein. Typically, in such a locking environment, the bracket $B_1$ would be secured to a moveable door, while the bracket $B_2$ would be secured to a second door or a wall, such that the brackets $B_1$, $B_2$ are held together in the illustrated manner with the lock passing therethrough so as to prevent unauthorized opening of the door.

Turning now to FIGS. 2 and 3, the construction of the lock 1 and its manner of use will be self-evident. That is, the lock 1 is formed of two relatively massive protective members 2, 3 which serve to protect the lock against forced opening by impact or the like. In this regard, the term "relatively massive" is intended to define the fact that the members 2, 3 are of a strong, heavy material, such as steel, and its walls are relatively thick in comparison to its diameter and at least of a minimum thickness sufficient to resist impacts such as by hammer blows. For example, it has been found satisfactory to utilize cylinders of stainless steel having a 25 mm diameter, a minimum wall thickness in the vicinity of the lock plug of approximately 3 mm with a wall thickness in the region within which the cylinders are coupled of approximately 9 mm.

With reference specifically to FIG. 2, it can be seen that the lock housing 2 has a male portion 4 at one end of reduced circumference and which is non-circular in transverse cross section. While any non-circular cross sectional shape can be utilized for the purpose to be noted in greater detail below, a particularly suitable configuration has been found which greatly facilitates manufacture and use. More particularly, as is illustrated in FIG. 2, the portion 4 may be formed of a transverse cross section in the shape of a square having sides 5 that are beveled at their free ends 5*a* and rounded corners 6. The bevels 5*a* make it easier to insert the portion 4 of lock housing 2 into the sleeve member 3, while the portion 4 of such a cross sectional shape can be easily manufactured by reducing the diameter of housing 2 with a suitable milling tool or the like and then removing two pairs of oppositely facing arc segments to produce the flats 5.

The sleeve member 3 has a blind bore 9, an outer end of which is configured to receive a portion of the lock housing portion 4, and an inner end 10 of which is threaded. The outer end of blind bore 9 is of a non-circular transverse cross section in the form of a circle having a radius that is slightly larger than, but closely conforming to, that of the rounded corner sections 6 of the lock housing portion 4, which circle has been superimposed upon a square 12 that is slightly larger than, but closely conforming to, the square form of the lock housing portion 4 defined by flat sides 5, the square 12 having a diameter less than that of the circle 11, but diagonals of greater length than the diameter of the circle 11. The opening formed by the circle and square 11, 12, for the purposes of the present application will be referred to as a "counterbore", but it should be understood that this is not intended in the conventional sense of a cylindrical recess for receiving the head of a screw or bolt. The counterbore need not extend all the way to the threaded inner bore portion 10, but rather can be separated therefrom (after extending for a depth of, for example, 5 mm.) by an enlarged cylindrical bore portion 13. This form of blind bore construction, it should be recognized, will greatly simplify manufacturing since it is much simpler to form bores of circular transverse cross section by drilling, milling or the like than it is to form bores or bore portions of non-circular cross section, and in this manner, the only planar portions that need be produced are the relatively small, 5 mm. deep corner portions 12.

Additionally, the configuration of the lock housing portion 4 and blind bore 9 not only facilitates manufacture thereof, but also improves the lock itself in comparison to one which, for example, utilizes mating rectangular configurations. That is, this particular configuration is particularly suitable for locks that are utilized in an outdoor environment or other environments wherein the lock will be exposed to grease, dirt and the like. Since the only contact between the lock housing portion 4 and the circumference of blind bore 9 occurrs between the lines bounding the rounded and flat portions 5, 6 of portion 4 and the lines separating the arc segments of circle 11 and the corners of square 12, (i.e. the planar surfaces 5 form cords relative to the circle portions 11) a minimum of force is required for insertion of the portion 4 into the blind bore 9. In the event that any grease or dirt may have accumulated on the circumference of the portion 4, it will be easily displaced from these junction lines into the gaps between the projecting portion 4 and the circumference of the blind bore 9 between the lines of contact, or will be simply stripped off altogether. Likewise, any foreign matter within the bore 9, need not be completely cleaned out as there will be ample room left within the bore for same even when the projecting portion 4 is inserted therein. However, these minimal lines of contact in no way affect the non-rotative coupling of the lock housing 2 with the sleeve member 3.

The third major component of the lock 1 is a key-operated, tumbler equipped, lock cylinder 14 containing a lock plug 14A to which a screw threaded rod 15 is secured in a manner whereby it is caused to rotate with rotation of the lock plug 14A by a key. For the lock cylinder 14, it is contemplated that a conventional screw lock such as the "Chicago Ace" lock series No. CH-4107 of the Chicago Lock Company be used. Such locks have seven pin tumblers and receive tubular type keys, and in the present environment, would require some 50 or more separate picking operations to unthread the rod 15 from the threaded portion 10 of sleeve member 3. The lock cylinder 14 is retained within a bore 16 of lock housing 2 with the threaded rod 15 extending free of the housing portion 4 after passing through the bore portion 16*a* which is slightly larger than the diameter of rod 15. The body of the lock cylinder itself is received within a main portion 16*b* of the lock housing and the bore 16 has an enlarged counterbore portion 16*c* for receiving the flange 20 of the lock plug 14. To secure the lock cylinder in place within the bore 16 of the lock housing 2, the lock housing 2 is provided with a set screw 17 which is threadably received within an opening 18. Set screw 17 is tightened into engagement with one of two flats 19 provided on the lock cylinder 14.

In order to render the lock weatherproof for exterior applications, a cover cap assembly 21 is provided. The cover cap assembly 21 is retained on the lock housing 22 by an externally threaded ring 22 of semi-elastic material being stretched over the periphery of lock housing 2 into a position whereat an internal abutment ring 23 of the sleeve 22 will engage within an annular recess 24 on the periphery of lock housing 2. In this regard, it has been found particularly advantageous if the set screw 17 and threaded hole 18 of the lock housing 2 are located in an area which will be covered by the sleeve 22 when it is mounted upon the lock housing 2. In this manner, it will not be readily apparent that the lock cylinder is detatachably retained within the lock housing 2 and the set screw 17 will be protected from becoming jammed due to rust or foreign matter. On the other hand, should it become necessary to remove the lock cylinder 14 for repair, replacement or the like, this capability will not be inhibited since the semi-elastic sleeve 22 can be removed to provide access to the set screw 17.

Additionally, embedded within the semi-elastic material of the sleeve 22 is one end of a flexible coupling, such as chain 25, the other end of which is embedded within the material of a plastic cover cap 26 that has internal threads for engaging with the external threads of the sleeve 22. Such a cover cap assembly 21 can be readily molded as a one piece unit. The chain 25 which may be metal or plastic, prevents loss of the cap 26, and since the cap 26 is always close at hand, the likelihood that it will not be utilized is reduced, and when it is utilized, the lock plug is effectively weather proofed.

In use of the FIGS. 1–3 embodiment, the free end of rod 15 and the portion 4 of lock housing 4 are inserted through an aperture in a hasp, such as formed by the brackets $B_1$, $B_2$, (a hasp being selected with an aperture large enough to receive lock housing portion 4 and less than the diameter of the main body of the lock housing 2, but preferably close to that of portion 4). Portion 4 is then inserted into blind bore 9 so that the free end of threaded rod 15 is at the entrance to the threaded bore portion 10 and then, with the aid of a key (not shown), the rod 15 is rotated so as to thread it down into the bore 10. Since the portion 4 of lock housing 2 is greater in length than the depth of the counterbore within sleeve member 3, the threaded rod 15 can be substantially fully received within threaded bore portion 10 while still providing an ample extent of lock housing portion 4 upon which the hasp can be retained. Preferably, the hasp will fill the full extent of any spacing existing between the facing end portions of lock housing 2 and sleeve member 3 which surround the portion 4, thereby providing no access thereto for purposes of destroying the lock by cutting or prying. During threading of the rod 15 into the bore portion 10, relative rotation between the lock housing 2 and the sleeve member 3 is precluded by the inability of portion 4 to rotate within the counter bore of sleeve member 3.

Turning now to the embodiment of FIGS. 4, 5, a shackle type lock environment will be described. In this connection, parts of this embodiment which are common to elements of the FIGS. 1–3 embodiment have reference numerals that differ from those of the corresponding part by a factor of 100.

In FIG. 4 is shown a shackle type lock 100 comprising a pair of semi-annular members 140, 141. The semi-annular members 140, 141 are hinged together at one end and each of a respective opposite end of these semi-annular members is tangentially, permanently fastened to one of a lock housing 102 and sleeve member 103, respectively, such as by welding. Such a shackle-type lock is useful as an anti-theft device for kingpin equipped trailers. The shackle members 140, 141 are given a height and internal diameter corresponding to the height and diameter of a circumferential trailer kingpin recess of a kingpin K so that the shackle is lockable about the kingpin K within the recess. The manner of locking a kingpin via such a lock is known, for example, from U.S. Pat. No. 3,269,159 which patent is incorporated by reference to the extent necessary to complete an understanding of the use of the present invention as a kingpin lock.

With reference to FIG. 5, it can be seen that a lock cylinder 114 is received within bore portions **116*b*, 116*c* of lock housing 102, and is held therein by a set screw 117 in a manner similar to that of the FIGS. 1–3 embodiment. Likewise, the lock cylinder 114 is shielded by a cover cap assembly 121 formed of a semi-elastic sleeve 123, chain 125, and cap 126 that is the same as cover cap assembly 21 of the FIGS. 1–3** embodiment.

However, since the existence of a male portion 4 would interfere with the pivotal closing of the shackle 140, 141, and since its function in preventing relative rotation between the lock housing 102 and the sleeve 103 is performed by the shackle members 140, 141 in the FIGS. 4, 5 embodiment, such is omitted in this embodiment. Likewise, if a stationary threaded bore similar to bore portion 10 of the FIGS. 1–3 embodiment were utilized, lock cylinder 114 could not be left secured within housing 102 since the free end of threaded rod 115 would prevent the shackle halves from being fully closed, yet could not be threaded into the sleeve member 103 until such was achieved. As noted in the Background portion of the present application, this problem was treated simply by making the lock plug removable and not inserting same until after the shackle has been closed as is the case of the speedometer cable fitting lock of U.S. Pat. No. 2,565,659 with associated disadvantages.

Thus, the FIGS. 4, 5 embodiment utilizes a modified construction for the locking sleeve member 103 that is designed to eliminate the need to remove the locking cylinder prior to each use of the locking device.

In the embodiment of FIGS. 4, 5 this modification takes the following form. Firstly, the threaded bore portion 110 for threadingly engageing the threaded rod 115 is formed in an axially displaceable sleeve 131 that is received within blind bore 109. The sleeve 131 approximately corresponds in external diameter to the internal diameter of the blind bore 109 so that the interior of the bore serves to guide and align the threaded bore portion 110. To retain the threaded sleeve 131 within the bore 109, an abutment ring 132 is fastened at the mouth of the blind bore 109, such as by spot welding or the like. To insure sufficient contact pressure between the threaded sleeve 131 and threaded rod 115 exists so as to enable the rod to be threaded into the bore 110 despite the fact that sleeve 131 is displaceable away from the rod 115, a coil spring or the like 133 is located in the blind bore 109 between the inner end of sleeve 131 and the bottom of the blind bore. In this manner, the sleeve 131 will be resiliently biased against the abutment ring 132 when the shackle members 140, 141 are spread apart, but can be displaced rearwardly against the pressure of spring 133 as the shackle is closed due to contact pressure applied by the end of threaded rod 115. Once the shackle is fully closed, the lock housing 102 and sleeve member 103 will be axially aligned and threading of the rod into the bore 100 can commence by turning of the lock plug with a key, as noted with regard to the first embodiment. As the threaded rod 115 moves into the threaded bore 110, the sleeve 131 will move from its retracted position towards its fully engaged position shown in FIG. 5, the spring 139 insuring that the sleeve 131 is applied against the end of rod 115 to insure the threading commences even when the rod 115 is of insufficient length to bottom-out the sleeve 131 within the bore 109.

After the locking operation has been completed, the cap 126 of the cap assembly 121 (which is identical to the cap assembly 21 of the FIGS. 1–3 embodiment) can be threaded onto the externally threaded sleeve 123 to weather proof the lock cylinder 114.

From the foregoing, it should be readily apparent how the present invention and the described embodiments thereof achieve all of the initially outlined objects. Furthermore, it should also be appreciated that the present invention is not limited to the specific forms of embodiment disclosed herein, various modifications being possible within the scope of the present invention. For example, while the bore **116*b* of constant diameter is shown in FIG. 5, to further strengthen lock housing 102, the bore 116*b* could be constructed of sections of progressively decreasing diameter so as to produce a bore that closely conforms to the shape of the lock plug inserted therein. In the arrangement of FIGS. 1–3, the projection 4 need not be substantially square, but could be circular with a single flat 5 being provided, the bore 9** being correspondingly modified, or various other configurations could be utilized which have non-circular transverse cross sections. Thus, I do not wish to be limited to the details shown and described herein, but intend to cover all such changes and modifications as are encompassed by the scope of the appended claims.

I claim:

1. A locking device comprising:

(a) a lock cylinder containing a lock plug that is rotatable by rotation of a key inserted in said lock cylinder, a threaded rod being connected to the lock plug so as to be rotatable therewith;

(b) a relatively massive cylindrical lock housing having a bore extending axially therethrough, a first portion of said bore extending from a first end of said housing being configured for receiving said lock cylinder and a second portion of said bore extending from an opposite end of said housing having an internal diameter that is slightly larger than the external diameter of the threaded rod, said lock cylinder being disposed in said first portion of the housing bore with said threaded rod extending axially from said housing through said second portion of the bore;

(c) fastening means in said lock housing for securing said locking cylinder against rotational and axial movements relative to said lock housing;

(d) a relatively massive cylindrical sleeve member having a blind bore therein and screw thread means in a portion of said blind bore for threadingly engaging said threaded rod; and (e) means on said lock housing and sleeve member for preventing said threaded rod and screw thread means from being threadingly engaged and disengaged by relative rotation between said lock housing and sleeve member.

2. Locking device according to claim 1, wherein said means for preventing comprises:

(a) a counterbore at an open end of the blind bore of said sleeve member, said counterbore having a non-circular transverse cross section and (b) at least a portion of the exterior of said lock housing at said opposite end, said portion of the exterior being of reduced circumference, non-circular in transverse cross section and at least partially receivable in said counterbore in a manner preventing relative rotation therebetween by engagement of said opposite end with the counterbore.

3. Locking device according to claim 2, wherein said portion of the lock housing is greater in length than the depth of said counterbore so as to enable a hasp to be secured thereon between said lock housing and sleeve member.

4. Locking device according to claim 2 or 3, wherein the non-circular cross section of said lock housing portion exterior is in the form of a square with circularly rounded corner sections, and wherein the non-circular cross section of the counterbore is in the form of circle of a radius closely conforming to that of said rounded corner sections that is superimposed upon a square closely conforming in diameter to the square form of said lock housing portion cross section, said square having a diameter less than that of said circle and diagonals of greater length than the diameter of said circle.

5. Locking device according to claim 1, wherein said means for preventing comprises a shackle, said shackle being formed of a pair of semi-annular members, and each of said semi-annular members being tangentially permanently fastened at one end to one of said lock housing and sleeve member and being pivotally connected to the other of said semi-annular member at an opposite end.

6. Locking device according to claim 5, wherein said screw thread means comprises an internally threaded, axially displaceable sleeve approximately corresponding in external diameter to the internal diameter of said blind bore, an abutment ring fastened at an open end of said blind bore and spring means between said axially displaceable sleeve and a bottom end of said blind bore for biasing said displaceable sleeve toward said abutment ring, wherein the length of sleeve is less than the distance between the abutment ring and the bottom of said blind bore by an amount corresponding at least to a maximum insertion length of said threaded rod into said blind bore, whereby said shackle can be brought into a fully closed position without said threaded rod being threadingly engaged with the displaceable sleeve.

7. Locking device according to claim 1 or 2 or 3 or 5 or 6, further comprising a cover cap assembly including an internally thread cover cap, an externally threaded ring of semi-elastic material and a flexible coupling interconnecting said cover cap and threaded ring, wherein said first end of the lock housing is provided with an external recess formation and wherein said threaded ring is provided with a complementarily shaped internal rib formation, said threaded ring being retained, under tension, on said lock housing with said rib formation engaged in said recess formation.

8. Locking device according to claim 7, wherein said fastening means is a set screw extending through said first end of the lock housing at a position hidden by said threaded ring.

9. Locking device according to claim 1, or 3 or 5, wherein said fastening means is a setscrew.

10. Locking device according to claim 5 or 6, wherein the shackle has a height and internal diameter corresponding to the height and diameter of a circumferential trailer kingpin recess, whereby said shackle is lockable about said kingpin within said recess so as to constitute an antitheft device for said trailer.

* * * * *